US008151504B1

(12) United States Patent
Aiston

(10) Patent No.: US 8,151,504 B1
(45) Date of Patent: Apr. 10, 2012

(54) ERGONOMIC FIREARM GRIP

(75) Inventor: Christopher Aiston, Mont Vernon, NH (US)

(73) Assignee: Stark Equipment Corp., Manchester, NH (US)

( * ) Notice: Subject to any disclaimer, the term of this patent is extended or adjusted under 35 U.S.C. 154(b) by 270 days.

(21) Appl. No.: 12/687,659

(22) Filed: Jan. 14, 2010

(51) Int. Cl.
*F41C 23/10* (2006.01)

(52) U.S. Cl. ..... 42/71.02; 42/71.01; 42/75.03

(58) Field of Classification Search ..... 42/71.01, 42/71.02, 75.03, 6, 7, 72, 73
See application file for complete search history.

(56) References Cited

U.S. PATENT DOCUMENTS 3,683,535 A * 8/1972 Lewis ..... 42/71.02
D257,166 S * 9/1980 Hogue ..... D22/104
5,406,731 A * 4/1995 Stevens ..... 42/71.02
D410,988 S * 6/1999 Hines ..... D22/108
6,631,579 B1 * 10/2003 Lauster et al. ..... 42/70.11
6,804,907 B1 * 10/2004 Slobodkin ..... 42/71.02
6,854,205 B2 * 2/2005 Wikle et al. ..... 42/71.02
7,506,469 B2 * 3/2009 Poulin et al. ..... 42/71.02
D600,310 S * 9/2009 Fitzpatrick et al. ..... D22/109
D616,957 S * 6/2010 Rievley et al. ..... D22/110
2006/0096147 A1 * 5/2006 Gussalli Beretta ..... 42/71.02
2007/0256347 A1 * 11/2007 Fitzpatrick et al. ..... 42/96

* cited by examiner

*Primary Examiner* — Michael David
(74) *Attorney, Agent, or Firm* — Robert R. Deleault, Esq.; Mesmer & Deleault, PLLC

(57) ABSTRACT

An ergonomic firearm grip includes a grip body having a front strap, a rear strap, a lower palm grip portion, and an upper firearm interface portion with parallel sides, a front interface end and a rear interface end, a rear strap extension connected to the rear strap adjacent the upper firearm interface portion where the rear strap extension has a rear curved surface portion that extends horizontally away from the rear strap at the junction of the rear strap extension and the rear strap and forming the rear interface end, and a front strap extension connected to the front strap where the front strap extension has a front curved surface portion that extends horizontally away from the front strap at the junction of the front strap extension and the front strap.

20 Claims, 6 Drawing Sheets

ERGONOMIC FIREARM GRIP

BACKGROUND OF THE INVENTION

1. Field of the Invention

The present invention relates generally to firearms. Particularly, the present invention relates to firearm grips.

2. Description of the Prior Art

Hand grips for firearms such as handguns and long rifles are well known in the prior art. Such hand grips are often formed of materials that are easy to grip to allow the user to better grasp the firearm handle. Some of the materials used are also compressible. Hand grips also come in many different styles, shapes and designs.

Some prior art hand grips have a removable rear gripping portion commonly called the "backstrap," which is removably fixed onto a grip body. This allows a user to replace the backstrap with others of a different finishing, material, shape, and size in order to best suit the hand of the shooter. These types of hand grips provide various coupling or locking means between the backstrap and the grip body.

Examples of these types of hand grips are disclosed. U.S. Pat. No. 6,804,907 (2004, Slobodkin) discloses an anatomical hand grip for a firearm. The hand grip provides a trigger finger support protrusion for the positioning of the mid-portion of the distal phalanx of the index trigger finger directly on the trigger. The grip includes two panels on each side of the handle, a grip side panel and a companion panel. The grip side panel includes a plurality of molded finger grooves within a lower grip portion and a substantially D-shaped (in thickness profile) trigger finger support protrusion with both greater thickness and greater extension towards the trigger than the upper part of its companion panel. The front part of the protrusion is significantly displaced forward towards the trigger so that the upper part of the grip panel is significantly wider than the corresponding part of its companion panel.

U.S. Patent Application Publication No. 2006/0096147 (2006, Beretta) discloses a firearm grip. The grip includes a body extending substantially in a development direction and a gripping portion removably mounted on the body in a rear area with reference to a trigger of the weapon. The gripping portion at least partially envelops and covers a rear surface and a tract of side surfaces of the body. Means for locking the gripping portion on the body operating in an inserting direction transversal to the development direction are arranged in at least one side portion of the body and the gripping portion. The means for locking includes first strikes associated with the gripping portion and offset in the development direction relative to second strikes associated with the body. Interference means are interposed between the first and second strikes for locking the gripping portion.

Other prior art hand grips do not attach to the "handle" of the firearm but provides or creates the firearm handle as a unitary grip or a modular grip that attaches to the firearm adjacent the trigger of the firearm.

U.S. Pat. No. 6,854,205 (2005, Wikle et al.) discloses a grip having an internal, inwardly stepped, battery storage chamber. The grip includes a housing having a pull tab attached to the housing, which removably covers an internal cavity such as an internal battery storage chamber. The battery storage chamber includes two storage cavities. Each cavity includes a series of inwardly stepped battery compartments that extend from a lower portion of the firearm grip to an upper portion of the firearm grip.

U.S. Patent Application Publication No. 2007/0256347 (2007, Fitzpatrick et al.) discloses a modular hand grip. The hand grip includes a base with a locking dovetail rail on a first side and a second opposite side configured to receive a rail. Back strap additions are provided capable of receiving the rail on the body, which are customizable to a user's preferences while the fore straps are provided with rails in a similar manner. Also provided is a storage compartment inside the main body, accessible from a bottom of the grip.

Despite some of the prior art disclosing that the certain grips are anatomical hand grips or have ergonomic designs, none of the prior art grips are truly ergonomically designed to minimize or eliminate hand fatigue when the firearm is being held by a user. All of the prior art hand grips require the user to "grip" or "grab" the firearm handle, which leads to hand fatigue Therefore, what is needed is a firearm hand grip that is ergonomically configured to minimize or eliminate hand fatigue for a user.

SUMMARY OF THE INVENTION

It is an object of the present invention to provide a firearm hand grip that is ergonomically configured to minimize or eliminate hand fatigue for a user.

The present invention achieves these and other objectives by providing an ergonomic hand grip having an ergonomically-designed grip body with an ergonomically-designed rear hand positioning feature and an ergonomically-designed front hand positioning feature. These special features of the ergonomic firearm grip reside in the rear and front grip extensions of the firearm grip. The present invention also has other optional features that augment the ergonomic design of the firearm grip, which includes a front strap angle, a thumb rest or shelf, a palm swell, a flared grip bottom, and a front strap tang.

The rear hand positioning feature has a rear grip extension, also called an arching back strap extension. This feature is a circular arc that extends upward from the back strap and ends at a point that is between about 75 degrees and about 90 degrees toward the vertical axis of the center point of the circular arc with an optional upper rear extension surface that is tangent to the circular arc. The rear grip extension extends in a horizontal direction from the junction of the back strap and the rear grip extension a distance of no less than about 0.5 inches and no greater than about 1.7 inches. The optional upper rear extension surface has an angle of inclination between about 0 degrees to about 15 degrees depending on the arc angle of the circular arc. It should be understood that the upper rear extension surface is optional only when the rear strap extension extends horizontally at least 0.5 inches.

The unique design of the rear grip extension serves three purposes. The first purpose is to position the hand such that when the trigger finger is extended toward the trigger and touches the front surface of the trigger that is the vertex of the curved shape of the front surface, which is called for purposes of this disclosure the trigger center TC, the trigger finger is generally parallel to the bore axis. The angle of approach of the trigger finger to the trigger is important to trigger control, which is important to the shooter's ability to repeatedly shoot the firearm accurately. A trigger finger that is in line with the bore axis (i.e. the centerline of the barrel) is less likely to move the firearm off target when the trigger finger pulls against the trigger. If the trigger finger is not in line with the bore axis, the firearm can be moved up or down when the trigger is pulled, causing the firearm to move off target. Another benefit of aligning the trigger finger with the bore axis is that the trigger finger points directly at the target. Humans have an instinctive ability to point at what they are looking at. Therefore, aligning the trigger finger with the bore axis allows the shooter to instinctively point their firearm at targets. This is taught by the U.S. Army Field Manual. It states the following:

When a soldier points, he instinctively points at the feature on the object on which his eyes are focused. An impulse from the brain causes the arm and hand to stop when the finger reaches the proper position. When the eyes are shifted to a new object or feature, the finger, hand, and arm also shift to this point. It is this inherent trait that can be used by the soldier to rapidly and accurately engage targets. (Chap. 2, Sect. II, US Army Field Manual 23-25, Combat Training With Pistols & Revolvers).

The vertical distance of the rear grip extension from the trigger center TC is in the range of about 0.17 inches to about 0.57 inches. Increasing or decreasing this distance causes the trigger finger to become less parallel with the bore axis of the firearm causing a reduction in the benefits described above.

The second purpose is to position the hand so that the distal pad of the trigger finger naturally reaches the center of the trigger face without having to stretch or excessively bend. The distance the trigger finger needs to extend in order to pull the trigger (trigger length of pull), and the portion of the finger used to contact the trigger face are important to trigger control. Contacting the trigger face with the distal pad of the trigger finger is more likely to result in a trigger pull that is straight rearward, and not introduce forces that affect the point of aim. If the distal joint, middle pad or middle joint of the finger are used, the trigger pull will be an arcing motion that will introduce lateral forces on the firearm and move the firearm off target. In addition, a trigger finger that is in a comfortable, unstrained position is more likely to have better trigger control.

The horizontal distance between the trigger center and the beginning of the curve of the rear grip extension is in the range of about 2.5 inches to about 2.9 inches. Increasing this dimension makes placing the distal pad of the trigger finger on the face of the trigger more difficult if not impossible for shooters with small hands. If the trigger finger has to extend excessively to reach the trigger face, the finger may not be able to bend properly so that the distal pad sits comfortably on the trigger face. Decreasing this dimension creates one of two situations: (1) The shooter has to excessively bend the trigger finger to place the distal pad on the trigger face, causing strain and increasing the likelihood of an inconsistent, erratic trigger pull, and (2) The shooter contacts the trigger face with a part of the trigger finger other than the distal pad, such as the distal joint, middle pad or middle joint. This situation causes the trigger pull to be an arcing motion rather than a straight rearward motion and introduces lateral forces that can move the firearm off target.

The third purpose is to provide a surface that contacts the hand in the area of the base of the thumb, such that some weight of the firearm can rest on the hand. The rear grip extension curves upward and rearward to a point where it is between about 65 degrees and about 90 degrees toward the vertical axis of the center point of the circular arc. For a rear grip extension having an arc degree between about 65 degrees to less than 85 degrees to the vertical, the rear grip extension includes an upper rear extension surface that is tangent to the circular arc and extends at least to the minimum rear extension distance described above. This creates a surface that can rest on the area of the hand near the base of the thumb between the thumb and the index finger, i.e. the web of the thumb. By resting the firearm grip on this area of the hand, the shooter does not have to use grasping force alone to carry the weight of the firearm. If grasping force alone is used to carry the firearm weight, the hand will become fatigued from constant exertion, reducing the shooter's ability to use fine motor skills to manipulate the firearm. Trigger control is particularly degraded when fine motor skills are reduced, resulting in decreased accuracy. If the rear grip extension does not incorporate dimensions within the ranges described, there will not be sufficient structure to comfortably and stably rest the firearm on the hand.

The front hand positioning feature has a front grip extension, also called a front strap extension. Most firearms have a trigger guard that prevents accidental activation of the trigger. By integrating the front grip extension (and optionally the trigger guard) into the grip using the unique design of the present invention, the functionality of the front grip extension and optional trigger guard of the firearm grip goes beyond that of other trigger guards, resulting in improvements in user comfort and firearm control. In regards to the firearm grip, the trigger guard is more accurately described as a front grip extension. In the operation of a firearm, the middle finger contacts the lower surface of the front strap extension/trigger guard. The relatively wide, smooth, slightly convex form of the front strap extension of the present invention does not concentrate force onto the middle finger but spreads it out over a greater surface area, which improves comfort and prevents skin abrasion. By designing the underside of the trigger guard to be comfortable, it encourages the operator to distribute some of the firearm weight to the middle finger. By allowing the side of the middle finger to carry some weight, the hand does not have to use grasping force alone to control the firearm. The front grip extension should extend a minimum of 0.5 inches from the point at which the extension begins to curve away from the front strap. An extension shorter than this will not provide a surface large enough to comfortably distribute weight onto the middle finger.

Another feature of the present invention is the front grip strap angle. Most firearm grips of rifles incorporate front grip strap angles of approximately 30 degrees from the vertical with some in the range greater than 20 degrees up to 30 degrees. Radial and ulnar deviation is the side-to-side movement of the hand at the wrist, toward or away from the thumb. As radial and ulnar deviation increases, hand strength is reduced. At a forty degree (40°) ulnar deviation, there is about a twenty-five percent (25%) decrease in available strength. When compared to other grips with a front grip strap angle of 30°, our preferred angle of 15° reduces ulnar deviation, which reduces wrist strain and lessens the decrease in hand strength.

The front grip strap angle of the present invention is in the range of about ten degrees (10°) to less than twenty degrees (20°) from the vertical. This angle range reduces ulnar deviation when holding a firearm in a variety of body positions. Increasing the front strap angle beyond this range increases ulnar deviation, increases wrist strain and decreases hand strength. Decreasing the front strap angle below this range causes radial deviation in some body positions, which strains the wrist and decreases hand strength.

A further feature of the present invention is the thumb rest or shelf. The thumb rest or shelf is a protruding shelf that positions the thumb so that it is generally parallel to the bore axis of the firearm. By supporting the thumb, the shelf reduces fatigue and strain in the thumb. The thumb rest or shelf should comfortably position the thumb parallel to the trigger finger. Pointing the thumb in the same direction as the trigger finger enhances a shooters ability to instinctively point at and, therefore, shoot and hit what they are looking at.

Still another feature of the present invention is the palm swell. The palm swell of the present invention is an ambidextrous palm swell. It fills the palm and improves grip stability and comfort. Filling the palm increases the area of contact between the hand and the grip. Increasing the area of contact distributes pressure and friction more evenly in the hand, improving comfort and reducing the grasping force required for a firm grip.

Other features of the present invention include the lower front grip strap tang, which prevents the hand from slipping down off of the grip, and the flared bottom. The entire lower portion of the grip flares outward from the grip body forming the flared bottom. The hypothenar (heel) of the hand can push against these flared surfaces to control the movement of the firearm.

One embodiment of the present invention incorporating the unique features above includes an ergonomic firearm grip having a grip body with a front strap, a rear strap, a lower palm grip portion, and an upper firearm interface portion with parallel sides, a front interface end and a rear interface end where the front strap extends at a downward vertical angle from a centerline of the upper firearm interface portion, the centerline of the upper firearm interface portion being parallel to a gun barrel on a firearm to which the firearm grip is attached. The ergonomic firearm grip also includes a rear strap extension and a front strap extension. The rear strap extension is connected to the rear strap adjacent the upper firearm interface portion where the rear strap extension has a rear curved surface portion that extends laterally away from the rear strap at the junction of the rear strap extension and the rear strap. The rear strap extension extends at least about 0.5 inches horizontally in an arc configuration. The rear strap extension connects to the rear interface end and extends from the rear strap a distance no greater than about 1.7 inches. The rear strap extension forms an arc with at least a 65 degree arc angle from the horizontal beginning at the junction of the rear strap and the rear strap extension and an upper surface portion of the rear curved surface portion that extends rearwardly from the arc when the arc angle is between about 65 degrees and about 85 degrees. When the rear strap extension incorporates the upper surface portion, it is an upper rear extension tangent to the arc having an angle of inclination to the horizontal no greater than 15 degrees. The front strap extension is connected to the front strap adjacent the upper firearm interface portion where the front strap extension has a front curved surface portion that extends laterally away from the front strap at the junction of the front strap extension and the front strap at least about 0.5 inches in an arcing configuration. The front strap extension has an upper surface portion of the front curved surface portion that is parallel to the centerline of the upper firearm interface. The vertical distance between the upper surface portion of the rear strap extension and the upper surface portion of the front strap extension is in a range of about 0.8 inches to about 1.6 inches.

In another embodiment of the firearm grip of the present invention, the front strap vertical angle is an angle from the vertical in a range of about 10 degrees to less than 20 degrees with a preferred angle of 15 degrees.

In a further embodiment of the firearm grip of the present invention, the rear curved surface portion is an arc having a radius in the range of about 0.5 inches to about 0.8 inches.

In still another embodiment of the present invention, the rear curved surface portion has a convex cross-sectional surface between the sides of the upper firearm interface portion. The convex, cross-sectional surface has a continuous, transitional surface with a radius in the range of about 0.20 inches to about 1.0 inches.

In yet another embodiment of the present invention, the front curved surface portion of the front strap extension is an arc having a radius in the range of about 0.3 inches to about 0.525 inches.

In another embodiment of the present invention, the front curved surface portion has a convex cross-sectional surface between the sides of the upper firearm interface portion. The convex cross-sectional surface has a continuous transitional surface with a radius in the range of about 0.75 inches to about 3.5 inches.

In a further embodiment of the present invention, the firearm grip includes a thumb rest connected to a side of the grip body and extending transversely to the longitudinal axis of the grip body and located on the grip body vertically between the front strap extension and the rear strap extension. The thumb rest extends outwardly from the sides of the upper firearm interface portion from the front interface end across a major portion of the side of the grip body towards the rear interface end.

In still another embodiment of the present invention, the firearm grip includes an integral trigger guard connected to the front strap extension.

In yet another embodiment of the present invention, there is disclosed a method of making the ergonomic firearm grip.

DETAILED DESCRIPTION OF THE PREFERRED EMBODIMENT

Figure 1:
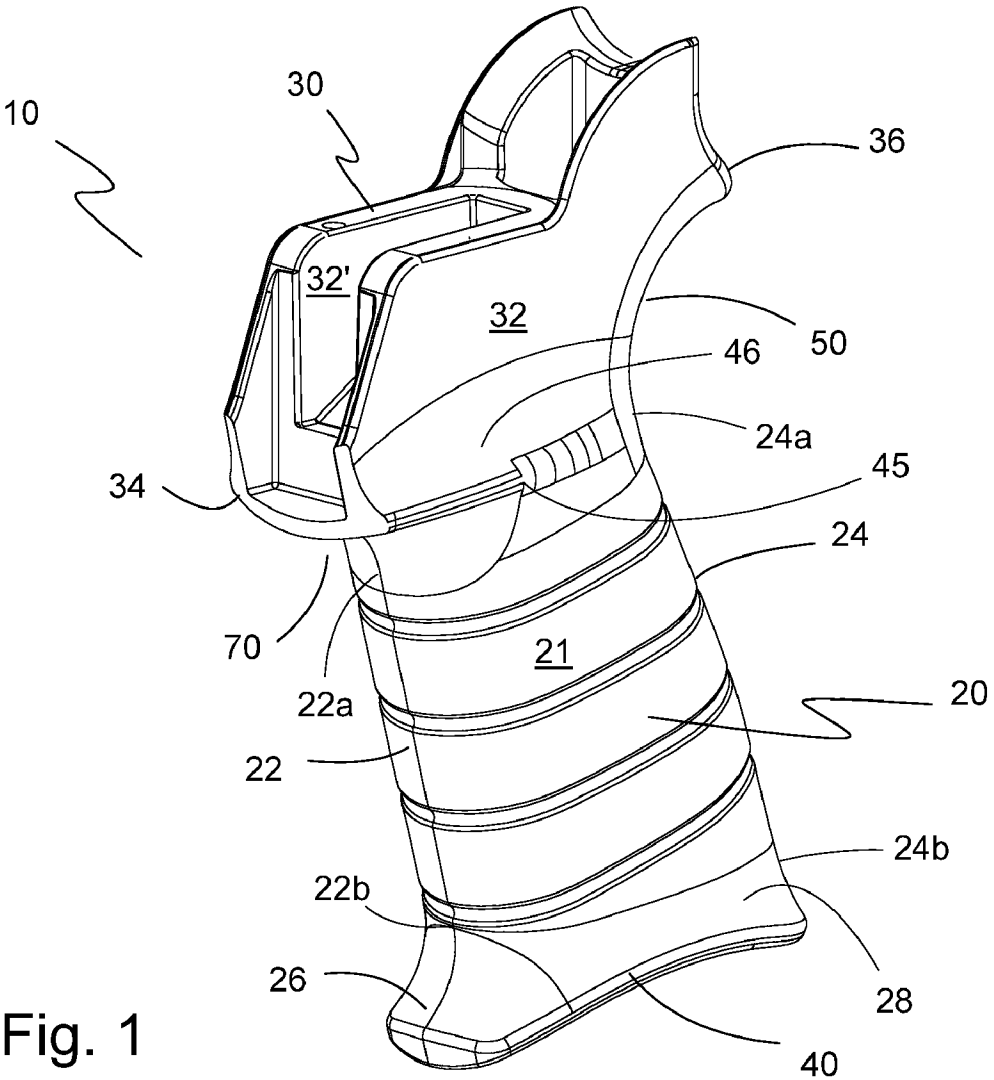
FIG. 1 is a perspective view of one embodiment of the present invention showing the ergonomic firearm grip.

The preferred embodiment(s) of the present invention is illustrated in FIGS. 1-8. FIG. 1 shows a perspective view of one embodiment of an ergonomic firearm grip 10 of the present invention. Ergonomic firearm grip 10 includes a grip body 20, a rear strap extension 50 and a front strap extension 70. Grip body 20 includes a pair of sides 21, 21' (not shown), a front strap 22, a rear strap 24, a lower palm grip portion 28, and an upper firearm interface portion 30. Front strap 22 and rear strap 24 have upper strap ends 22*a*, 24*a* and lower strap ends 22*b*, 24*b*, respectively. Upper firearm interface portion 30 has a pair of parallel sides 32, 32', a front interface end 34 and a rear interface end 36. Lower palm grip portion 28 includes a flared bottom 40 that extends outwardly from grip body 20 along the sides 21, 21' and a lower rear strap end 24*b*. Flared bottom 40 is sized so that the hypothenar, i.e. heel, of the hand may push against flared bottom 40 to control the movement of the firearm when held by a user. Front strap 22 includes a front strap tang 26 that curves forwardly from lower front strap end 22*b*. Front strap tang 26 extends outwardly a greater distance that flared bottom 40 and provides a surface that prevents the user's hand from slipping down off of grip body 20. Firearm grip 10 also includes a thumb rest or shelf 45 that extends between front interface end 34 towards the junction of upper rear strap end 24*a* and rear strap extension 50 where thumb rest or shelf 40 tapers back into body sides 21, 21' (not shown). This is more clearly shown in FIG. 3. Thumb shelf 45 protrudes from interface sides 32, 32' to provide a thumb supporting surface 46 from front interface end 34 so that the thumb is generally parallel to the axis of the firearm barrel, which reduces strain and fatigue in the thumb. Also, by positioning the thumb in the same direction as the trigger finger, thumb shelf 45 enhances a shooters ability to instinctively point at and shoot what the shooter is looking at.

Ergonomic firearm grip 10 has several features that include an ergonomically-designed grip body with an ergonomically-designed rear hand positioning feature and an ergonomically-designed front hand positioning feature. These special features of the ergonomic firearm grip reside in the rear and front grip extensions 50, 70, respectively. Firearm grip 10 of the present invention also has other optional features that augment the ergonomic design of the firearm grip. These optional features include a grip strap angle, a thumb rest or shelf, a palm swell, a flared grip bottom, and a front strap tang.

Figure 2:
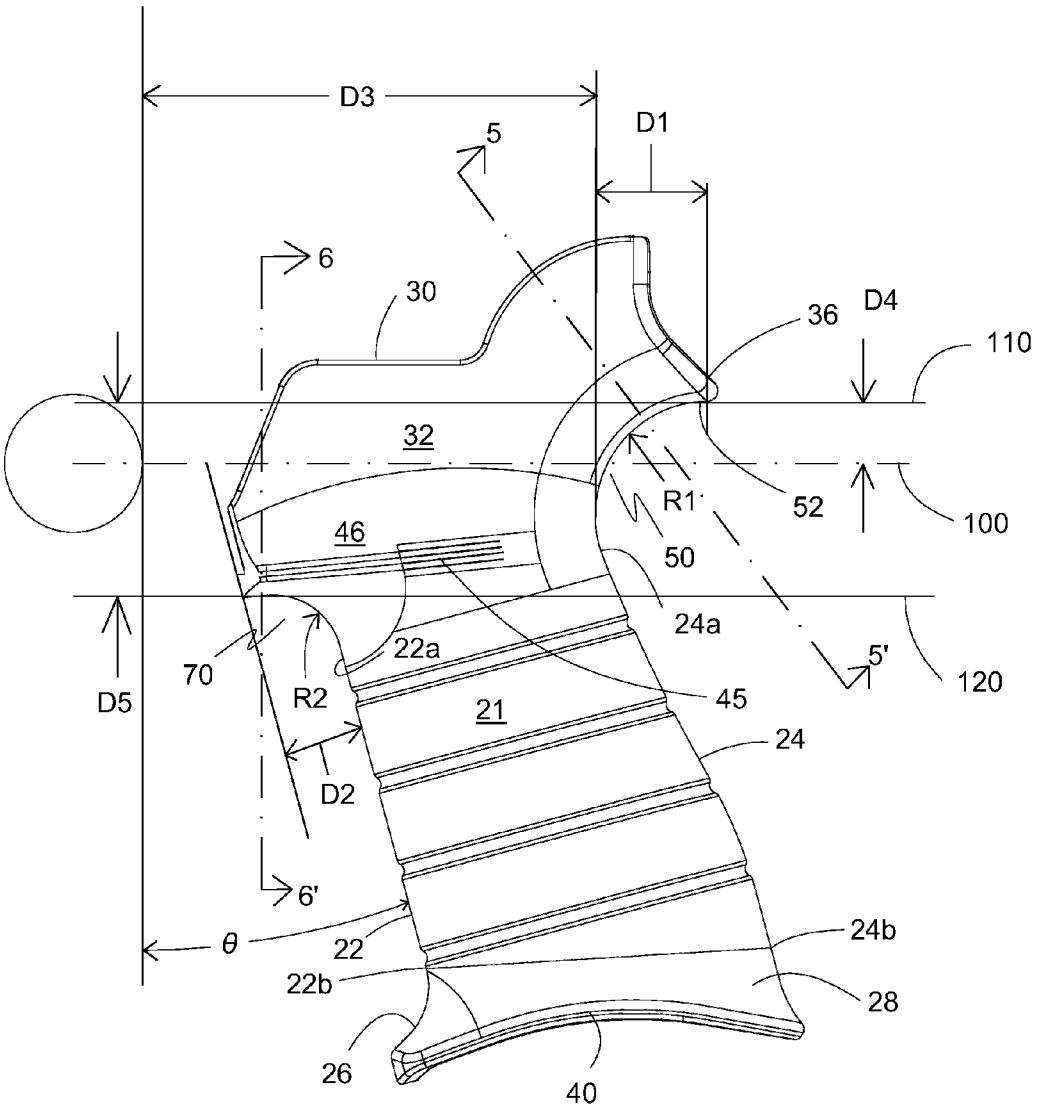
FIG. 2 is a side view of the embodiment shown in FIG. 1

FIG. 2 shows a side view of firearm grip 10 and the ergonomically-designed rear hand positioning feature and the ergonomically-designed front hand positioning feature. Line 100 represents the centerline of upper firearm interface portion 30, which is parallel to the bore axis of the firearm barrel when firearm grip 10 is mounted to the firearm. Line 100 also intersects with the center of the trigger face TC when firearm grip 10 is mounted to the firearm. As previously defined, the front surface of the trigger that is the vertex of the curved shape of the front surface, is defined as the trigger center TC for purposes of this disclosure. Line 110 represents the horizontal line that intersects the upper surface 52 of rear strap extension 50 adjacent rear interface end 36. There are a number of critical features of firearm grip 10 that provides the ergonomic benefits disclosed above, which are based on the relative positions of the ergonomically-designed grip body, the rear hand positioning feature and the front hand positioning feature. The ergonomically-designed rear hand positioning feature is represented by rear strap extension 50. Rear strap extension 50 is connected to upper rear strap end 24*a* and extends in a circular arc that extends upward from upper rear strap end 24*a* and ends at a point that is approximately in a range of about seventy-five degrees (75°) to about ninety degrees) (90° to the vertical with an optional upper rear extension surface 52 that is tangent to the circular arc. The circular arc has a radius R1 in the range of about 0.5 inches to about 0.8 inches. The horizontal distance D1 between the junction of upper rear strap end 24*a* and the rear interface end 36 is at least 0.5 inches and, preferably, in the range of about 0.5 inches to about 1.7 inches. The present invention has a preferred rear strap extension 50 that includes an arc angle of about eighty-eight degrees (88°) from the horizontal to the vertical and a radius of about 0.7 inches and a horizontal extension from the junction of the upper rear strap end 24*a* to rear interface end 36 of 0.7 inches. For rear strap extensions having an arc angle in the range between about 75 degrees (75°) and about 85 degrees (85°), there is the upper rear extension surface 52 that extends rearwardly from the arc. The upper rear extension surface 52 is a surface with an angle of inclination to the horizontal in the range of zero degrees (0°) to an angle that is no greater than the tangent to the arc radius at the point of transition from the arc angle to the rear extension surface 52. As an example, where the rear strap extension has an arc angle of 75°, the upper rear extension surface 52 would have an angle of inclination to the horizontal between 0° to 15° and would extend a distance sufficient to provide the minimum horizontal extension of 0.5 inches required for the rear strap extension 50. Another critical dimension is the distance D4 between line 110 and the centerline 100. D4 has a length in the range of about 0.120 inches to about 0.620 inches. Preferably, D4 has a length in the range of about 0.25 inches to about 0.49 inches. More preferably, D4 has a length of about 0.370 inches. This dimension is important to maintain the approach of the trigger finger to the center of the trigger face in a generally parallel position to the bore axis of the barrel. Proper alignment of the trigger finger is important to trigger control, which is important to the shooter's ability to repeatedly shoot the firearm accurately.

The ergonomically-designed front hand positioning feature is represented by front strap extension 70. Front strap extension 70 is connected to upper front strap end 22*a* and extends in a circular arc that extends upward and away from upper front strap end 22*a* and ends at a point that is approximately in a range of about one hundred degrees (100°) to about one hundred ten degrees (110°) to the vertical. The circular arc has a radius R2 in the range of about 0.3 inches to about 0.525 inches. The present invention has a preferred front strap extension that includes an arc angle of about one hundred five degrees (105°) from the horizontal to the vertical and a radius of about 0.425 inches. The front strap extension extends horizontally a distance D2 from the junction of the upper front strap end 22*a* to front interface end 34 at least about 0.5 inches. It is contemplated that, when the arc angle is between about 90 degrees and about 110 degrees, there may be an optional upper front extension surface portion 72 that extends forwardly and horizontally from the arc where the upper front extension surface portion 72 is a surface that is tangent to the arc radius at the point where the arc angle is equal to about ninety degrees (90°). The distance D5 between line 110 and line 120 is also an important dimension. This dimension is preferably in the range of about 0.6 inches to about 1.6 inches and, more preferably, a distance of about 1.190 inches.

As previously disclosed, the front strap angle is also an important feature. The front strap 22 defines a vertically declining surface that is linear. The front strap angle is the angle to the vertical at which the grip body 20 decends from the centerline of the firearm interface 30. The front strap angle is in the range of about ten degrees (10°) to less than twenty degrees (20°) from the vertical and represented by the angle θ. The preferred angle is fifteen degrees (15°).

Additionally, the distance D3 between the center TC of the front of the trigger of the firearm on which firearm grip 10 is attached and the junction of upper rear strap end 24*a* and rear strap extension is also important. Distance D3 is in the range of about 2.5 inches to about 3.0 inches. The preferred range is about 2.58 inches to about 2.98 inches, and the preferred distance being about 2.78 inches.

Figure 4:
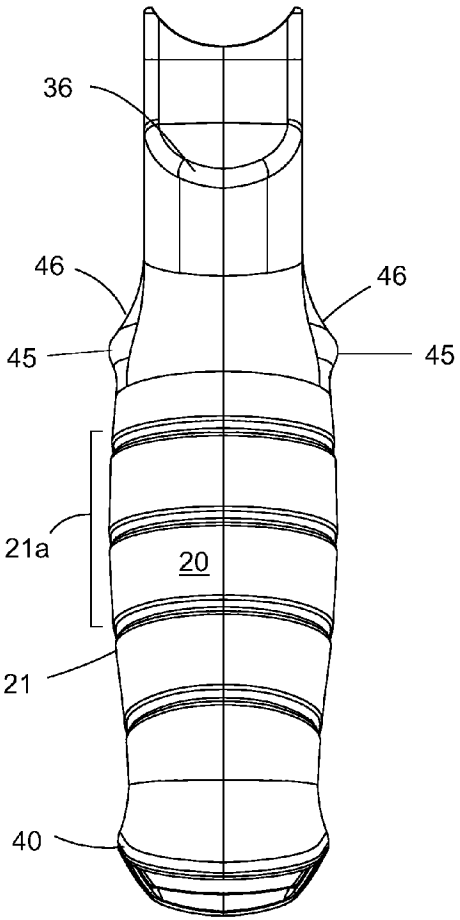
FIG. 4 is a rear view of the embodiment illustrated in FIG. 1 showing the palm swell on the grip body.
Figure 3:
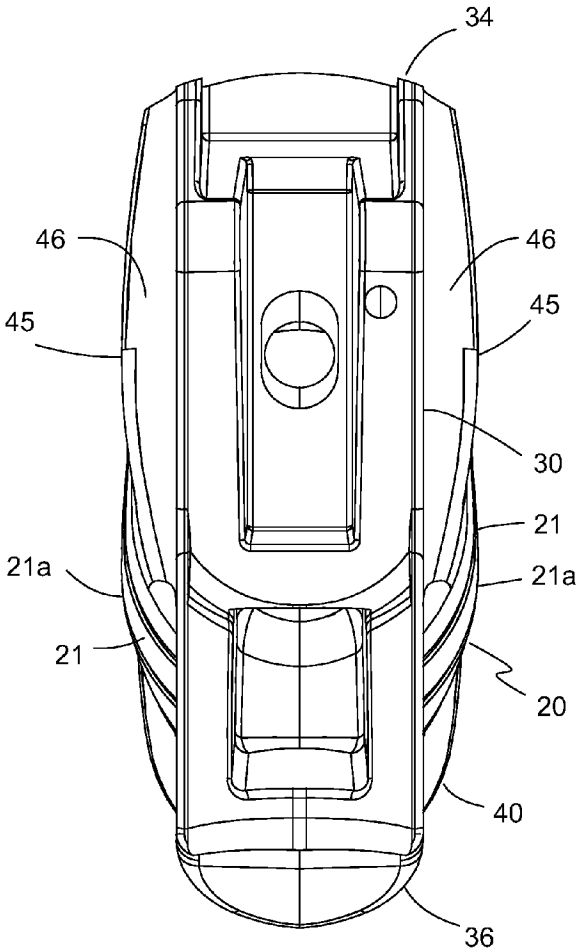
FIG. 3 is a top view of the embodiment illustrated in FIG. 1 showing the thumb shelf.

Turning now to FIG. 3, there is shown a top view of firearm grip 10. FIG. 3 clearly shows several of the advantageous features of the present invention. As can be seen, thumb rest or shelf 45 provides a support surface 46 on each side of grip 10. Also shown is a palm swell 21*a* on sides 21, 21'. Incorporating thumb rest or shelf 45 and palm swell 21*a* on both sides of grip 10 presents grip 10 as an ambidextrous grip providing the beneficial features of the present invention equally to both right-handed and left-handed shooters. Palm swell 21*a* increases the area of contact between the shooter's hand and the grip. An increased area of contact distributes pressure and friction more evenly in the shooter's hand, which improves comfort and reduces the grasping force required for a firm grip. FIG. 4 shows a back view of grip body 20 with the palm swell 21*a* more clearly delineated.

Figure 5:
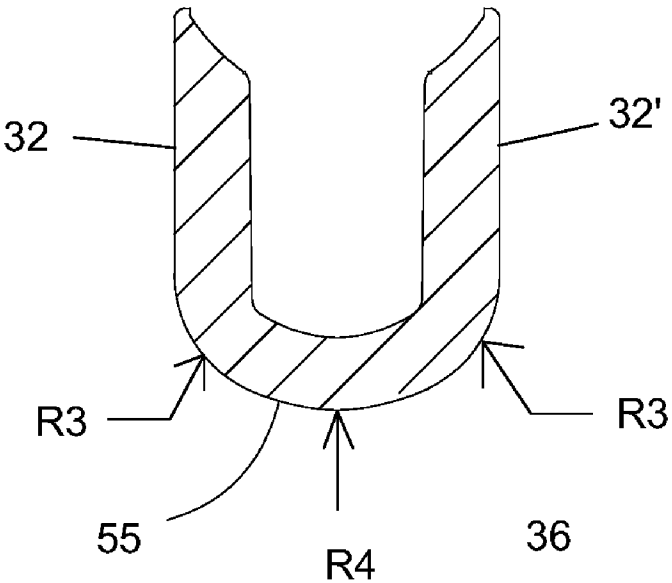
FIG. 5 is a cross-sectional view of the rear strap extension.

FIG. 5 is a cross-sectional view of rear strap extension 50 taken along line 5-5' in FIG. 2. In order to provide additional ergonomic comfort, rear strap extension 50 has a cross-section with a curved surface 55. Curved surface 55 is a convex curved surface. The convex curved surface 55 may have a single radius or it may be a transitional surface with different sections where each section has a different cross-sectional radius. In the preferred embodiment, curved surface 55 includes a smaller radius R3 at the junction of interface sides 32, 32' and rear interface end 36 while rear interface end 36 has a larger radius R4. For grip 10 shown in FIG. 2, the smaller radius is preferably 0.35 inches and the larger radius is preferably 0.61 inches. A fillet edge at the junction of the interface sides 32, 32' and rear interface end 36 to eliminate the corner created by the two intersecting surfaces 32, 36 and 32', 36 is also contemplated by and within the scope of the present invention.

Figure 6:
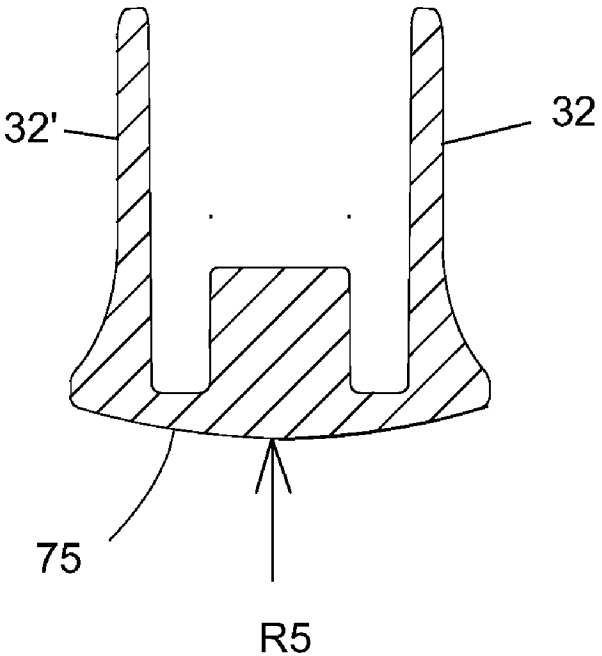
FIG. 6 is a cross-sectional view of the front strap extension.

FIG. 6 is a cross-sectional view of front strap extension 70 taken along line 6-6' in FIG. 2. In order to provide additional ergonomic comfort, front strap extension 70 has a cross-section with a convex curved surface 75. Convex curved surface 75 preferably has a radius R5 in the range of about 0.84 inches to about 3.34 inches. More preferably, the radius is 2.9 inches. The width of convex curved surface 75 is preferably in the range of about 0.56 inches to about 1.26 inches. More preferably, the width of convex curved surface 75 is 1.16 inches.

Figure 7:
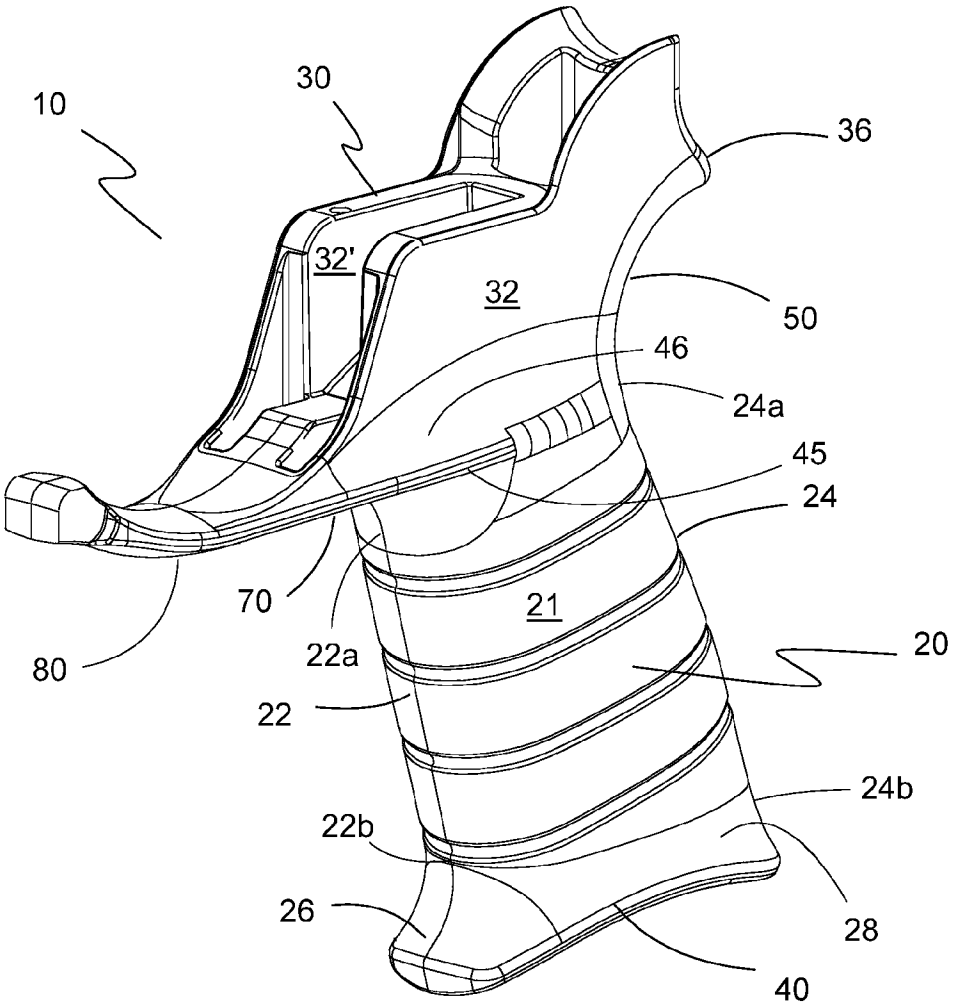
FIG. 7 is a perspective view of another embodiment of the present invention showing an integral trigger guard.

Turning now to FIG. 7, there is shown another embodiment of the firearm grip 10 of the present invention. In this embodiment, ergonomic firearm grip 10 includes grip body 20, rear strap extension 50, front strap extension 70, and a trigger guard 80. Like the embodiment in FIG. 1, grip body 20 includes the pair of sides 21, 21' (not shown), front strap 22, rear strap 24, lower palm grip portion 28, and upper firearm interface portion 30. Front strap 22 and rear strap 24 have upper strap ends 22*a*, 24*a* and lower strap ends 22*b*, 24*b*, respectively. Upper firearm interface portion 30 has parallel sides 32, 32', front interface end 34 connected to trigger guard 80 and rear interface end 36. Lower palm grip portion 28 includes flared bottom 40 that extends outwardly from grip body 20 along the sides 21, 21' and lower rear strap end 24*b*. Front strap 22 includes front strap tang 26 that curves forwardly from lower front strap end 22*b*. Front strap tang 26 extends outwardly a greater distance that flared bottom 40 and provides a surface that prevents the user's hand from slipping down off of grip body 20. Firearm grip 10 also includes thumb rest or shelf 45 that extends between a rear portion of trigger guard 80 towards the junction of upper rear strap end 24*a* and rear strap extension 50 where thumb rest or shelf 45 tapers back into body sides 21, 21' (not shown). Thumb shelf 45 protrudes from interface sides 32, 32' to provide a thumb supporting surface 46.

Figure 8:
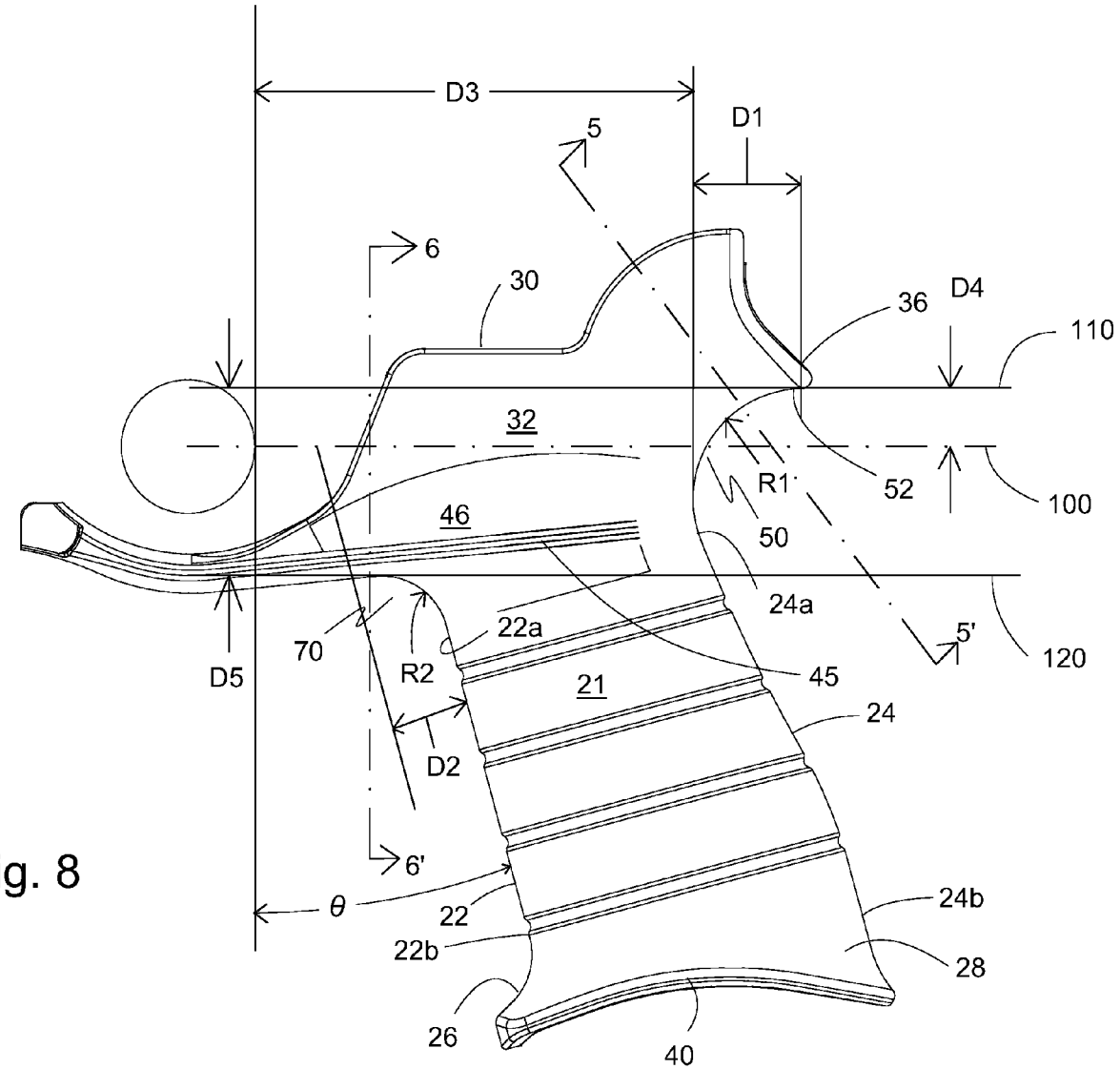
FIG. 8 is a side view of the embodiment shown in FIG. 7.

FIG. 8 is a side view of the embodiment of firearm grip 10 illustrated in FIG. 7. The embodiment in FIG. 8 has ergonomic features that are identical to the ergonomic features disclosed in the embodiment in FIG. 1. Rear strap extension 50 is connected to upper rear strap end 24*a* and extends in a circular arc that extends upwards and away from upper rear strap end 24*a* and ends at a point that is approximately in a range of about sixty-five degrees (65°) to about ninety degrees (90°) to the vertical with an optional upper rear extension surface 52 that is tangent to the circular arc. The circular arc has a radius R1 in the range of about 0.5 inches to about 0.8 inches. The horizontal distance D1 between the junction of upper rear strap end 24*a* and the rear interface end 36 is at least 0.5 inches and, preferably, in the range of about 0.5 inches to about 1.7 inches.

Front strap extension 70 is connected to upper front strap end 22*a* and extends in a circular arc that extends upward from upper front strap end 22*a* and ends at a point that is approximately in a range of about one hundred degrees (100°) to about one hundred ten degrees (110°) to the vertical. The circular arc has a radius R2 in the range of about 0.3 inches to about 0.525 inches. The front strap extension extends horizontally a distance D2 from the junction of the upper front strap end 22*a* to trigger guard 80 at least about 0.5 inches.

As previously disclosed, the front strap angle is in the range of about ten degrees (10) to less than twenty degrees (20) from the vertical and represented by the angle θ. The preferred angle is fifteen degrees (15°).

Additionally, the distance D3 between the trigger center TC of the front of the trigger of the firearm on which firearm grip 10 is attached and the junction of upper rear strap end 24*a* and rear strap extension is in the range of about 2.5 inches to about 3.0 inches. The preferred range is about 2.58 inches to about 2.98 inches, and the preferred distance being about 2.78 inches.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An ergonomic firearm grip comprising:

a grip body having a front strap, a rear strap, a lower palm grip portion, and an upper firearm interface portion with parallel sides, a front interface end and a rear interface end wherein the grip body extends at a downward vertical angle from a centerline of the upper firearm interface portion, the centerline of the upper firearm interface portion being parallel to a gun barrel and intersecting with the center of a trigger face on a firearm to which the firearm grip is attached;

a rear strap extension connected to the rear strap adjacent the upper firearm interface portion wherein the rear strap extension has a rear curved surface portion that extends horizontally away from the rear strap at the junction of the rear strap extension and the rear strap to the rear interface end at least about 0.5 inches in an arc configuration and that extends from the rear strap a distance no greater than about 1.7 inches, the rear strap extension forming an arc with at least a 75 degree arc angle and an upper rear extension surface that extends rearwardly from the arc when the arc angle is less than or equal to 85 degrees, the upper rear extension surface being a rear extension surface having an angle of inclination to the horizontal from the rear curved surface portion no greater than 15 degrees; and a front strap extension connected to the front strap adjacent the upper firearm interface portion wherein the front strap extension has a front curved surface portion that extends horizontally away from the front strap at the junction of the front strap extension and the front strap at least about 0.5 inches in an arcing configuration, the front strap extension having an upper surface portion of the front curved surface portion that is parallel to the centerline of the upper firearm interface wherein the vertical distance between the upper surface portion of the rear strap extension and the upper surface portion of the front strap extension is in a range of about 0.8 inches to about 1.6 inches.

2. The grip of claim 1 wherein the downward vertical angle from the centerline of the upper firearm interface is an angle from the vertical in a range of about 10 degrees to less than 20 degrees.

3. The grip of claim 2 wherein the downward vertical angle is about 15 degrees.

4. The grip of claim 1 wherein the rear curved surface portion is an arc having a radius in the range of about 0.5 inches to about 0.8 inches.

5. The grip of claim 4 wherein the rear curved surface portion is an arc having a radius of about 0.7 inches.

6. The grip of claim 1 wherein the rear curved surface portion has a convex cross-sectional surface between the sides of the upper firearm interface portion wherein the convex cross-sectional surface has a continuous transitional surface with a radius in the range of about 0.2 inches to about 1.0 inches.

7. The grip of claim 1 wherein the vertical distance between the upper surface portion of the rear strap extension and the centerline of the upper firearm interface portion is in the range of about 0.12 inches to about 0.62 inches.

8. The grip of claim 1 wherein the front curved surface portion is an arc having a radius in the range of about 0.3 inches to about 0.525 inches.

9. The grip of claim 8 wherein the front curved surface portion is an arc having a radius of about 0.425 inches.

10. The grip of claim 1 wherein the front curved surface portion has a convex cross-sectional surface between the sides of the upper firearm interface portion wherein the convex cross-sectional surface has a continuous transitional surface with a radius in the range of about 0.75 inches to about 3.5 inches.

11. The grip of claim 1 further comprising a thumb rest shelf connected to a side of the grip body and extending transversely to the longitudinal axis of the grip body and located on the grip body vertically between the front strap extension and the rear strap extension, the thumb rest shelf extending outwardly from the sides of the upper firearm interface portion.

12. The grip of claim 1 further comprising an integral trigger guard connected to the front strap extension.

13. The grip of claim 12 wherein the trigger guard and the front strap extension are a unitary component.

14. A method of making an ergonomic firearm grip comprising:

forming a grip body having a front strap, a rear strap, a lower palm grip portion, and an upper firearm interface portion, a front interface end and a rear interface end wherein the grip body extends at a downward vertical angle from a centerline of the upper firearm interface portion, the centerline of the upper firearm interface being parallel to a gun barrel on a firearm to which the firearm grip is attached;

forming a rear strap extension connected to the rear strap adjacent the upper firearm interface portion wherein the rear strap extension has a rear curved surface portion that extends horizontally away from the rear strap at the junction of the rear strap extension and the rear strap to the rear interface end of at least about 0.5 inches in an arc configuration and extends horizontally from the rear strap a distance no greater than about 1.7 inches, the rear strap extension forming an arc with at least a 75 degree arc angle and an upper rear surface extension of the rear curved surface portion that extends rearwardly from the arc when the arc angle is less than or equal to 85 degrees, the upper rear extension surface being a rear extension surface having an angle of inclination to the horizontal no greater than 15 degrees; and forming a front strap extension connected to the front strap adjacent the upper firearm interface portion wherein the front strap extension has a front curved surface portion that extends horizontally away from the front strap at the junction of the front strap extension and the front strap at least 0.5 inches, the front strap extension having an upper surface portion of the front curved surface portion that is parallel to the centerline of the upper firearm interface wherein the vertical distance between the upper surface portion of the rear strap extension and the centerline of the upper firearm interface portion is in a range of about 0.12 inches to about 0.62 inches.

15. The method of claim 14 wherein the grip body forming step includes extending the grip body at a downward vertical angle in the range of about 10 degrees to about 20 degrees.

16. The method of claim 14 wherein the rear strap extension forming step includes incorporating a curved surface portion having an arc with a radius in the range of about 0.5 inches to about 0.8 inches.

17. The method of claim 16 wherein the arc incorporating step includes forming the rear curved surface with an arc degree of at least 75 degrees and forming a rear extension portion connected to the rear curved surface that is parallel to the centerline of the upper firearm interface portion.

18. The method of claim 14 wherein the front strap extension forming step includes incorporating a front curved surface portion having an arc with a radius in the range of about 0.3 inches to about 0.525 inches.

19. The method of claim 14 further comprising forming a thumb rest shelf connected to the side of the grip body and extending transversely to the length of the grip body and located vertically between the front strap extension and the rear strap extension, the thumb rest shelf extending outwardly from the sides of the upper firearm interface portion.

20. The method of claim 14 further comprising forming an integral trigger guard connected to the front strap extension.

* * * * *